US006371286B1

(12) United States Patent
Montanari

(10) Patent No.: US 6,371,286 B1
(45) Date of Patent: Apr. 16, 2002

(54) DEVICE FOR HOLDING A PLURALITY OF TOOTHED BLADES OF FLANKED KEYS THAT MAY BE SELECTED AND PULLED OUT ONE BY ONE

(76) Inventor: Pierluigi Montanari, via Alpi Apuane 44, 00141 Rome (IT)

( * ) Notice: Subject to any disclaimer, the term of this patent is extended or adjusted under 35 U.S.C. 154(b) by 0 days.

(21) Appl. No.: 09/622,669

(22) PCT Filed: Dec. 10, 1999

(86) PCT No.: PCT/IT99/00407

§ 371 Date: Aug. 22, 2000

§ 102(e) Date: Aug. 22, 2000

(87) PCT Pub. No.: WO00/36946

PCT Pub. Date: Jun. 29, 2000

(51) Int. Cl.[7] ..... A45C 11/32

(52) U.S. Cl. ..... 206/37.3; 206/37.4; 206/37.6; 10/456 R

(58) Field of Search ..... 206/37, 37.2, 37.3, 206/37.4, 37.8, 38.1, 493, 425; 70/456 R, 408

(56) References Cited

U.S. PATENT DOCUMENTS

| | | | | | |
|---|---|---|---|---|---|
| 2,228,726 | A | * | 1/1941 | Loesch | 206/37 |
| 2,694,921 | A | | 11/1954 | Kerner | |
| 2,990,086 | A | * | 6/1961 | Williams | 206/493 |
| 3,147,609 | A | | 9/1964 | Ryan | |
| 3,335,858 | A | * | 8/1967 | Sibille | 206/493 |
| 4,033,455 | A | * | 7/1977 | Robison | 206/408 |
| 5,201,414 | A | * | 4/1993 | Kaszubinski | 206/309 |
| 5,215,190 | A | * | 6/1993 | Hoffpauir, Jr. | 206/37.2 |
| 5,232,086 | A | | 8/1993 | Montanari | |
| 5,299,688 | A | * | 4/1994 | McKay et al. | 206/425 |
| 5,533,620 | A | * | 7/1996 | Torterolo | 206/408 |
| 5,630,658 | A | * | 5/1997 | Jeter | 312/107 |

FOREIGN PATENT DOCUMENTS

| | | |
|---|---|---|
| DE | 297 20 170 | 3/1998 |

* cited by examiner

*Primary Examiner*—Shian Luung
(74) *Attorney, Agent, or Firm*—Young & Thompson

(57) ABSTRACT

A device for holding a plurality of toothed blades of flanked keys that may be selected and pulled out one by one. Each key has a groove with a preferably triangular section along the whole length of the edge resting against the bottom of the device for sliding along ribs of equal sections on the bottom of the device.

9 Claims, 2 Drawing Sheets

DEVICE FOR HOLDING A PLURALITY OF TOOTHED BLADES OF FLANKED KEYS THAT MAY BE SELECTED AND PULLED OUT ONE BY ONE

BACKGROUND OF THE INVENTION

The present invention concerns an improvement of the devices containing a plurality of toothed blades of flanked keys that may be selected and pulled out one by one.

The prior art already knows Italian patent no. 1232242, filed by the same applicant, as well as international publication no. WO 91/03185, granted as U.S. Pat. No. 5,232,036 and as European Patent no. 0442970, concerning a device containing a plurality of toothed blades of flanked keys that may be selected and pulled out one by one, and in which keys are placed in reciprocal contact, inserted in a horizontally movable slide inside said container, wherein the position of the keys is determined by the contact between the relative walls, by the vertical back of the blade that gets into a corresponding seat of the slide, and by the groove on the upper edge of the blade by means of which it gets hooked to the square guide beam of the top.

In the realization of the device according to mentioned patent, some difficulties have shown in its working:

- when the blade is selected and the upper side of the container is turned downwards, the toothed edge of the blade tends to get stuck in the longitudinal slit in the middle of the top, thus blocking the transversal movement of the slide;
- sometimes it happens that the necessary, even if very little plays, between one blade and the other get summed preventing the pulling out thereof because the point of the blade turns away from the longitudinal axis and finds an obstacle against the edge of the outlet slit, in spite of the rounding of the slit's edges and of the point of the blade;
- when it happens that blades of different lengths (corrsponding to locks with a three or four pin block, wherein said pins are shorter than the more common five pins) are flanked in the slide, it may occur that one blade flanked to a shorter one may be pulled out of the container but often finds an obstacle when it must be placed back: infact, the shorter blade lacks the lateral support of the pulled out blade and when opening the lock, the rotation of the container frequently causes—due to gravity—the deviation of the short blade into the lateral space that now is free, and thus its point invades the running of the pulled out blade and blocks the same.

The disadvantages of mentioned patent are shown in the enclosed FIGS. 1 and 2, in which respectively the theoric and regular movement of the five-pin blades is shown as well as the deviation and the following blocking of the return of the pulled out blade.

SUMMARY OF THE INVENTION

It is the aim of the present improvement to completely solve above mentioned working difficulties.

The aim set forth is reached by means of the improvement according to the present invention, consisting of blades guided by parallel, equidistant walls obtained inside said slide, preferably of the same height of the blades between which they are put, for the precision of the pulling out and return of said blades; furthermore, each blade shows a groove with a preferably triangular section along the whole length of the resting edge against the bottom of the slide, for the precise sliding along the ribs of equal sections obtained thereon.

BRIEF DESCRIPTION OF THE DRAWINGS

The structure and the working of the improvement according to the present invention will be described more in detail hereinbelow, relating to the enclosed drawings in which some embodiments are shown.

Figure 1:
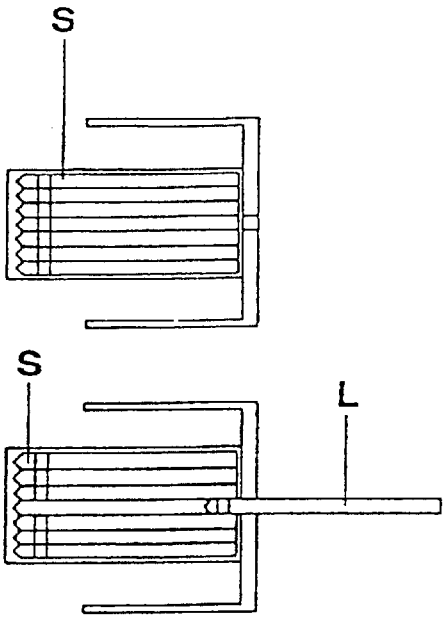
FIG.1 PRIOR ART
FIGS. 1 and 2 depict problems of the prior art.
Figure 2:
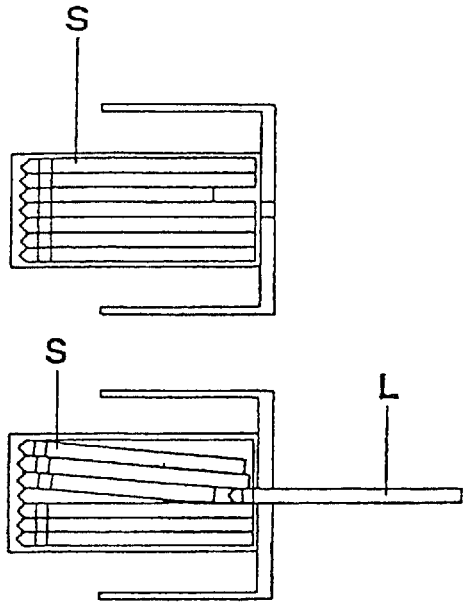
FIG.2 PRIOR ART
Figure 3:
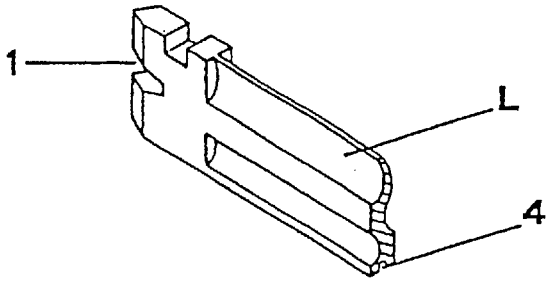
FIGS. 3 and 4 show an upper and lower axonometric view of a blade provided with a groove having a trapezoidal shape.
Figure 4:
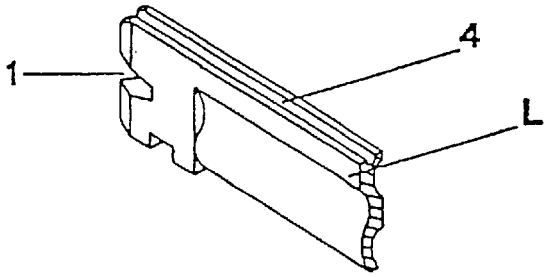
Figure 5:
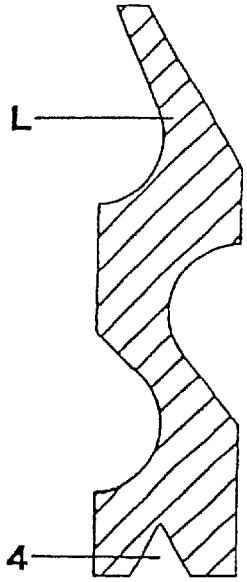
FIGS. 5 and 6 show the section of a blade according to the present invention and of a variant thereof.
Figure 6:
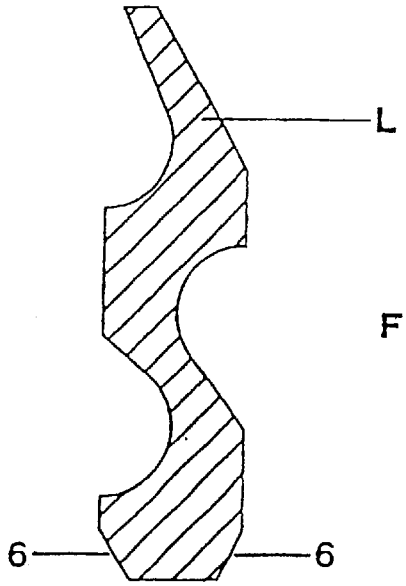
Figure 7:
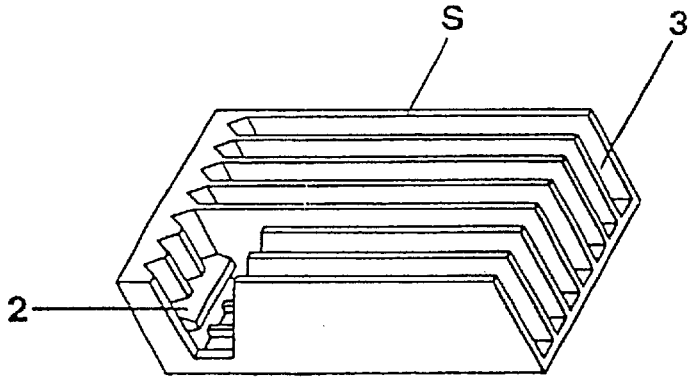
FIG. 7 shows an axonometric view of the slide of one embodiment of the present invention.
Figure 8:
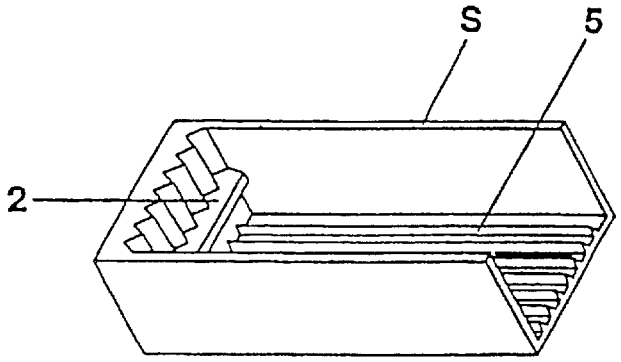
FIG. 8 shows the ribs obtained on the bottom of the slide in another embodiment of the present invention.

The enclosed figures show an improvement of the devices containing a plurality of toothed blades of flanked keys that may be selected and pulled out one by one and in which said blades L—for preventing above mentioned catching due to gravity—show, at about the middle of their vertical edge, a groove 1 of trapezoidal shape to which corresponds, on the vertical wall with flanked dihedrons of said slide S, a shelf 2 having a section of equal shape that projects horizontally for the whole inner width of said slide, so that when said blades L are retracted said grooves get wedged into said corresponding shelf for impeding the vertical play of said blades L, which are kept in contact with the bottom of said slide. Furthermore, for solving all remaining above mentioned inconveniences, said blades L are always kept in their exact position during their translatory motion as well as during their puling out or return motion, by means of interposed vertical walls 3, inside said slide, equidistant and parallel, and which form a series of housings for each single blade which, sliding in its own seat without any contact with the other blades, is guided with absolute precision along its whole running.

Alternatively, so as to avoid, maintaining the same number of blades, a greater encumbrance of said container than the one of the mentioned patent—due to the thickness of the guiding walls—, i.e. with the same width, avoiding to reduce the number of the available blades (and, in particular, for facilitating the pressing of said slide), and blade L has, on its lower edge and along the whole length thereof, a groove 4 with a triangular section, each of which gets inserted onto corresponding small ribs 5 with equal section obtained on the bottom of said slide: thus, each blade follows its own obligated run, remaining flanked to the other keys and grazing them at the limit of the reciprocal contact.

In a variant according to the present invention, ribs are provided between one blade and the other and the lower edge thereof has, in correspondence, two rounding offs 6 with the same inclination of the guiding ribs.

Obviously, above described shape of the toothed blade is more complex than the one of a conventional Yale-key and, consequently, this might involve higher production costs. For reducing the costs and at the same time improving the product's quality (greater lightness and non-deformability, reduced time needed for duplication, a greater duration of the cutters in the duplicators), it is possible to make use of non metallic materials with first-rate working features and equal reliability, like carbon fibres, fiberglass and some plastics of the last generations, suitably loaded. Furthermore, said plastic materials are suitable for being produced by means of injection pressing with further economic advantages, and may also be used with the same pressing process used for conventional keys, radicaly reducing their weight.

What is claimed is:

1. A container holding a plurality of toothed key blades, each of said plurality of key blades comprising a lateral side with a first groove of generally trapezoidal section and a longitudinal side with a second groove of generally triangular section extending an entire length of said longitudinal side, and said container comprising a wall receiving said lateral sides of said plurality of key blades and a bottom receiving said longitudinal sides of said plurality of key blades, said wall having on an entire width thereof a shelf that is generally parallel to said bottom and that engages said first grooves of said plurality of key blades, and said bottom having plural parallel, longitudinally extended ribs that each engages a respective one of said second grooves of said plurality of key blades.

2. The container holding a plurality of toothed key blades as in claim 1, wherein each of said ribs is generally triangular and extends an entire longitudinal length of said bottom.

3. The container holding a plurality of toothed key blades as in claim 1, wherein a side of said container opposite said wall is open and wherein said ribs extend to said open side.

4. The container holding a plurality of toothed key blades as in claim 1, wherein said shelf is generally trapezoidal.

5. The container holding a plurality of toothed key blades as in claim 1, wherein each of said ribs is generally triangular and extends an entire longitudinal length of said bottom, wherein a side of said container opposite said wall is open and said ribs extend to said open side, and wherein said shelf is generally trapezoidal.

6. A container holding a plurality of toothed key blades, each of said plurality of key blades comprising a lateral side with a first groove of generally trapezoidal section and a longitudinal side with opposite edges that are tapered along an entire length of said longitudinal side, and said container comprising a wall receiving said lateral sides of said plurality of key blades and a bottom receiving said longitudinal sides of said plurality of key blades, said wall having on an entire width thereof a shelf generally parallel to said bottom that engages said first grooves of said plurality of key blades, and said bottom having plural parallel, longitudinally extended, generally triangular ribs, wherein each of two opposing sides of each of said ribs engages a respective one of said tapered edges of said plurality of key blades.

7. The container holding a plurality of toothed key blades as in claim 6, wherein a side of said container opposite said wall is open and said ribs extend to said open side.

8. The container holding a plurality of toothed key blades as in claim 6, wherein said shelf is generally trapezoidal.

9. The container holding a plurality of toothed key blades as in claim 6, wherein a side of said container opposite said wall is open and said ribs extend to said open side, and wherein said shelf is generally trapezoidal.

* * * * *

UNITED STATES PATENT AND TRADEMARK OFFICE

CERTIFICATE OF CORRECTION

PATENT NO. : 6,371,286 B1
DATED : April 16, 2002
INVENTOR(S) : Pierluigi Montanari It is certified that error appears in the above-identified patent and that said Letters Patent is hereby corrected as shown below:

Title page,
Insert item [30] as follows:

-- [30] Foreign Application Priority Data
December 22, 1998 [IT] Italy . . . . . RM98A000788 --.

Signed and Sealed this

Third Day of September, 2002

*Attest:*

*Attesting Officer*

JAMES E. ROGAN
*Director of the United States Patent and Trademark Office*